US007001092B1

(12) United States Patent
Varughese

(10) Patent No.: US 7,001,092 B1
(45) Date of Patent: Feb. 21, 2006

(54) CRAYON (ERASEABLES)

(76) Inventor: Bincy Varughese, 7 Parkway Dr., New City, NY (US) 10956

( * ) Notice: Subject to any disclaimer, the term of this patent is extended or adjusted under 35 U.S.C. 154(b) by 0 days.

(21) Appl. No.: 11/131,132

(22) Filed: May 16, 2005

Related U.S. Application Data

(60) Provisional application No. 60/585,976, filed on Jul. 8, 2004.

(51) Int. Cl.
*A45D 40/20* (2006.01)

(52) U.S. Cl. ..... 401/88; 401/66; 401/82; 401/99; 401/75; 401/111

(58) Field of Classification Search ..... 401/55, 401/56, 66, 75, 83–88, 99, 111, 117
See application file for complete search history.

(56) References Cited

U.S. PATENT DOCUMENTS 544,609 A * 8/1895 Boman ..... 401/55
1,750,912 A 3/1930 Towne
1,865,325 A * 6/1932 MacLeod ..... 401/179
1,967,301 A * 7/1934 Ferris et al. ..... 401/59
3,989,392 A * 11/1976 Seidler ..... 401/66
4,778,300 A * 10/1988 French et al. ..... 401/55
4,812,069 A * 3/1989 White et al. ..... 401/195
4,911,569 A * 3/1990 Hashimoto et al. ..... 401/55
4,951,856 A * 8/1990 Horgan ..... 224/218
5,048,989 A * 9/1991 Stageman ..... 401/83
6,022,161 A * 2/2000 Choi ..... 401/99
6,071,029 A * 6/2000 Weinstock ..... 401/158
6,505,984 B1 1/2003 Smith

* cited by examiner

*Primary Examiner*—Khoa D. Huynh

(57) ABSTRACT

A type of writing apparatus. The writing apparatus is a modified crayon that includes an attached eraser and has an outer plastic sleeve that serves as the gripping mechanism when in use. An individual can rotate the attached eraser and expel the crayon slowly out of the open of the plastic sleeve as the crayon is used up. In addition, the crayon itself has incorporated metallic additives, sparkling additives, and various scents.

4 Claims, 2 Drawing Sheets

CRAYON (ERASEABLES)

I. CROSS-REFERENCE TO RELATED APPLICATIONS

This application claims the benefit of U.S. Provisional Application No. 60/585,976, filed Jul. 8, 2004.

II. BACKGROUND OF THE INVENTION

The present invention concerns that of a new and improved type of crayon.

III. DESCRIPTION OF THE PRIOR ART

U.S. Pat. No. 6,505,984, issued to Smith, discloses a crayon, for marking paper, having an eraser incorporated for removing a mark from the paper.

U.S. Pat. No. 5,048,989, issued to Stageman, discloses a crayon holder device.

U.S. Pat. No. 1,750,912, issued to Towne, discloses a combination eraser and caulk holder for use on a blackboard.

IV. SUMMARY OF THE INVENTION

The present invention concerns that of a new and improved type of writing apparatus. The writing apparatus is a modified crayon that includes an attached eraser and has an outer plastic sleeve that serves as the gripping mechanism when in use. An individual can rotate the attached eraser and expel the crayon slowly out of the open of the plastic sleeve as the crayon is used up. In addition, the crayon itself has incorporated metallic additives, sparkling additives, and various scents.

There has thus been outlined, rather broadly, the more important features of a writing apparatus that the detailed description thereof that follows may be better understood and in order that the present contribution to the art may be better appreciated. There are, of course, additional features of the writing apparatus that will be described hereinafter and which will form the subject matter of the claims appended hereto.

In this respect, before explaining at least one embodiment of the writing apparatus in detail, it is to be understood that the writing apparatus is not limited in its application to the details of construction and to the arrangements of the components set forth in the following description or illustrated in the drawings. The writing apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present writing apparatus. It is important, therefore, that the claims be regarded as including such equivalent constructions insofar as they do not depart from the spirit and scope of the present invention.

It is therefore an object of the present invention to provide a writing apparatus which has all of the advantages of the prior art and none of the disadvantages.

It is another object of the present invention to provide a writing apparatus which may be easily and efficiently manufactured and marketed.

It is another object of the present invention to provide a writing apparatus which is of durable and reliable construction.

It is yet another object of the present invention to provide a writing apparatus which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
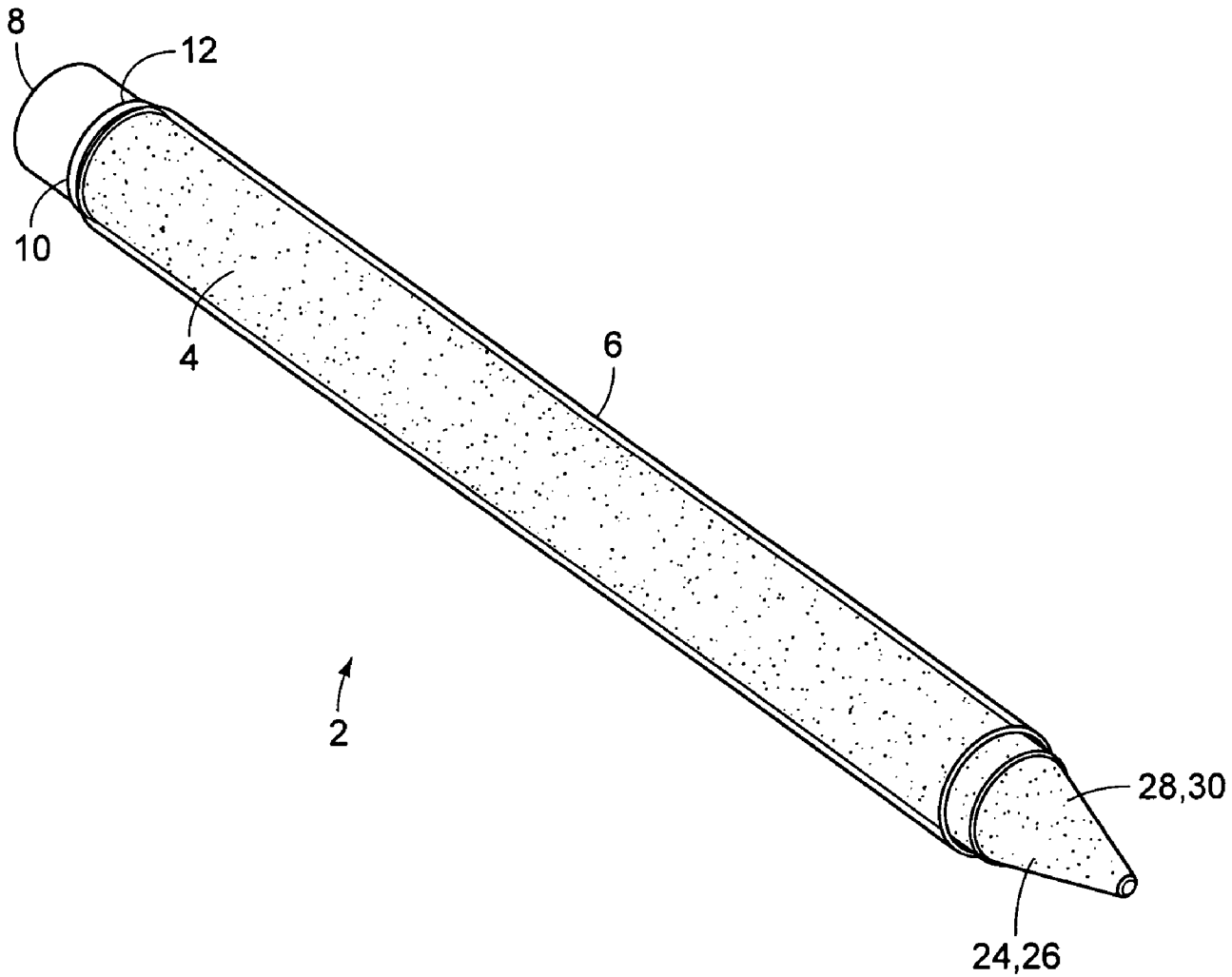
FIG. 1 shows a perspective view of the writing apparatus.

FIG. 1 shows a perspective view of the writing apparatus 2. Writing apparatus 2 comprises a crayon 4 that has two ends, a writing end and a closed end. Crayon 4 itself is enveloped in a plastic sleeve 6 that has two ends, an open end and an eraser end, with the plastic sleeve 6 also having two surfaces, an inner surface and an outer surface. The writing end of the crayon 4 itself sticks out a short distance from the open end of the plastic sleeve 6 to allow an individual to write with the writing end of the crayon 4.

The eraser end of the plastic sleeve has an attached eraser 8 which is rotatably attached to the inside perimeter of the eraser end of the plastic sleeve 6. An individual can use the eraser 8 to erase writings created by the crayon 4. The eraser 8 is attached to the ring 10, which itself is attached to the inside perimeter of the eraser end of the plastic sleeve 6.

The writing apparatus also has a special characteristic which allows virtually the entire length of the crayon 4 to be utilized. The writing apparatus has the ability to "push" the writing end of the crayon 4 forward as the writing end of the crayon is used so that more and more of the crayon 4 will actually be ejected through the open end of the plastic sleeve 6. This characteristic allows the crayon 4 to always have a specific length to grasp onto and prevents shorter or stubby crayons from being thrown away by toddlers or children because the crayon 4 might simply be too short to properly wield. The actual length of the writing apparatus is not measured by the actual length of the crayon 4 itself, but rather, by the length of the plastic sleeve 6, which serves as the outer casing of the writing apparatus 2 itself.

Located near the closed end of the crayon 4 is a platform 12, which is shaped like a flat disc and is mounted on two tracks 14 and 16 that are located within the plastic sleeve. Each track has two ends, a first end and a second end, with the first end of each track being located near the eraser end of the plastic sleeve 6 and the second end of each track being located near the open end of the plastic sleeve 6. The tracks run parallel to one another and are placed 180 degrees from one another on the inner surface of the plastic sleeve 6.

The material 24 used to make the actual crayon 4 itself has items added to it. Specifically, the material 24 preferably has sparkling additives 26, an incorporated scent 28, and metallic additives 30, and furthermore, is washable when needed.

Figure 2:
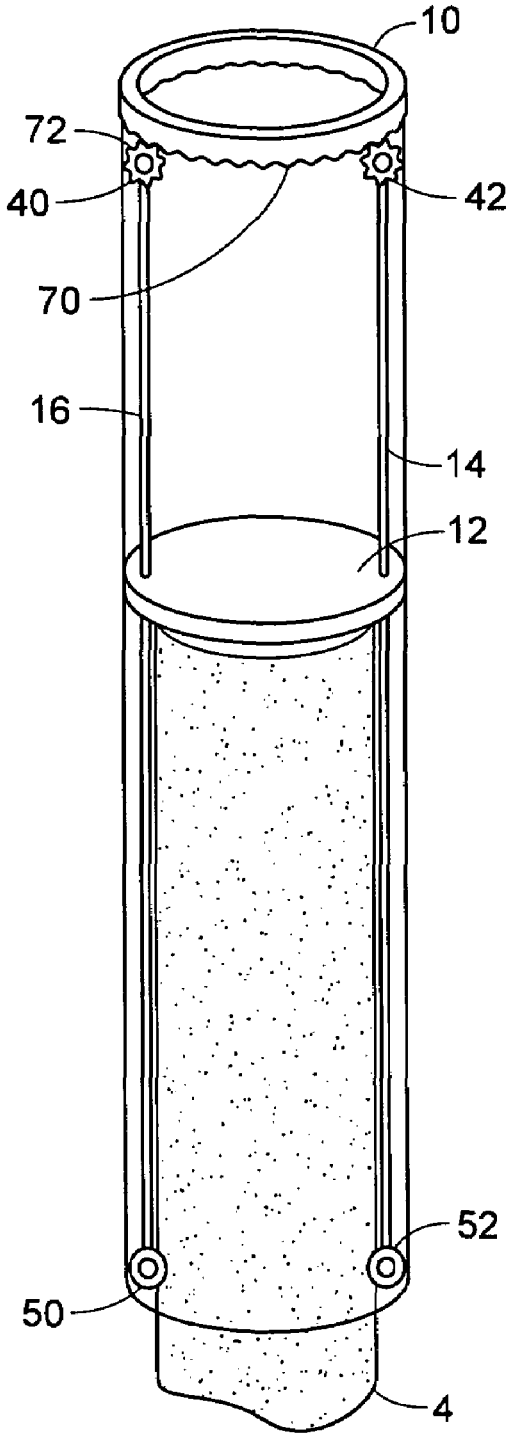
FIG. 2 shows a close-up of the mechanism that is used to push the crayon out of the plastic sleeve.

FIG. 2 shows a close-up of the mechanism that is used to push the crayon out of the plastic sleeve. Ring 10, platform 12 is shown, along with tracks 14 and 16, along with the closed end of the crayon 4. The ring 10 has two surfaces, a top surface and a bottom surface, with the bottom surface of the ring 10 being the surface that faces the crayon 4. The bottom surface of the ring 10 has a plurality of incorporated teeth 70.

The first end of track 14 is wound around gear 42, while the second end of track 14 is wound around roller 52. The first end of track 16 is wound around gear 40, while the second end of track 16 is wound around roller 50. Gears 40 and 42 are axially mounted against the inner surface of the plastic sleeve 6 and also have a plurality of teeth 72. Because the plurality of teeth 72 on the gears 40 and 42 are in direct contact with the plurality of teeth 70 on the bottom surface of the ring 10, the gears 40 and 42 rotate when the ring 10 is rotated. Rollers 50 and 52 are axially attached to the inner surface of the plastic sleeve 6 near the open end of the plastic sleeve 6 and rotate about their axis.

When ring 10 is rotated, platform 12 moves toward or away from the open end of the plastic sleeve 6, depending on the way in which the ring 10 is rotated. Platform 12 is fixedly attached to a specific location on each of the tracks 14 and 16. Tracks 14 and 16 move forward or backward when the ring 10 is rotated, causing the platform 12 itself to move forward or backward. Ring 10 itself is rotated when an individual would grasp the eraser 8 and rotate it.

When the platform 12 moves forward, it causes the writing end of the crayon 4 to be further expelled out of the open end of the plastic sleeve 6. This will allow, eventually, the entire length of the crayon 4 to be used for writing, thereby saving people money and causing less resources to be used in creating additional crayons.

I claim:

1. A writing apparatus comprising:

(a) a plastic sleeve having two ends, an open end and an eraser end, the plastic sleeve also having two surfaces, an inner surface and an outer surface, (b) a crayon having two ends, a writing end and a closed end, the crayon being located inside the plastic sleeve, the writing end of the crayon sticking out a short distance from the open end of the plastic sleeve, (c) an eraser rotatably attached to the eraser end of the plastic sleeve, (d) means for adjusting the position of the crayon in relation to the plastic sleeve, wherein the means for adjusting the position of the crayon in relation to the plastic sleeve further comprises:

(a) a pair of tracks mounted within the plastic sleeve, the pair of tracks comprising a first track and a second track, each of the tracks having two ends comprising a first end and a second end, the first end of each track being located near the eraser end of the plastic sleeve and the second end of each track being located near the open end of the plastic sleeve, the two tracks running parallel to one another, the two tracks being 180 degrees from one another on the inner surface of the plastic sleeve, (b) a platform mounted on the pair of tracks, the platform being disc-shaped, (c) a ring attached to the inside perimeter of the eraser end of the plastic sleeve, the ring having two surfaces, a top surface and a bottom surface, the bottom surface of the ring having a plurality of teeth, (d) a pair of gears comprising a first gear and a second gear, the first end of the first track being wound around the first gear, the first end of the second track being wound around the second gear, wherein each of the gears are axially mounted against the inner surface of the plastic sleeve, further wherein each of the gears have a plurality of teeth, further wherein the plurality of teeth on each of the gears are in contact with the plurality of teeth on the bottom surface of the ring, (e) a pair of rollers comprising a first roller and a second roller, the second end of the first track being wound around the first roller, the second end of the second track being wound around the second roller, wherein each of the rollers are axially mounted against the inner surface of the plastic sleeve near the open end of the plastic sleeve and rotate about their axis, (f) wherein rotation of the ring causes the platform to move toward or away from the open end of the plastic sleeve.

2. The writing apparatus according to claim 1 wherein the crayon further comprises sparkling additives.

3. The writing apparatus according to claim 2 wherein the crayon further comprises an incorporated scent.

4. The writing apparatus according to claim 3 wherein the crayon further comprises metallic additives.

* * * * *